United States Patent [19]

Kobayashi et al.

[11] Patent Number: 5,074,764

[45] Date of Patent: Dec. 24, 1991

[54] SUBMERGIBLE MOTOR PUMP

[75] Inventors: Makoto Kobayashi, Kanagawa; Shinji Nishimori, Fukuoka; Yoshio Miyake, Kanagawa, all of Japan

[73] Assignee: Ebara Corporation, Tokyo, Japan

[21] Appl. No.: 503,823

[22] Filed: Apr. 3, 1990

[30] Foreign Application Priority Data

| | | | |
|---|---|---|---|
| Apr. 6, 1989 | [JP] | Japan | 1-39995[U] |
| Dec. 20, 1989 | [JP] | Japan | 1-145894[U] |
| Dec. 26, 1989 | [JP] | Japan | 1-148585[U] |
| Jan. 11, 1990 | [JP] | Japan | 2-902[U] |
| Jan. 17, 1990 | [JP] | Japan | 2-2403[U] |

[51] Int. Cl.[5] ..... F04D 13/08

[52] U.S. Cl. ..... 417/423.3; 417/423.9; 417/424.1

[58] Field of Search ..... 417/423.3, 423.9, 424.1

[56] References Cited

U.S. PATENT DOCUMENTS 1,721,692 7/1929 Carson .
3,153,382 10/1964 Van Blarcom, Jr. .

FOREIGN PATENT DOCUMENTS 0328075 8/1989 European Pat. Off. .
1121931 1/1962 Fed. Rep. of Germany .
3609311 10/1987 Fed. Rep. of Germany .
63-98497 6/1988 Japan .
443001 1/1968 Switzerland .
895256 5/1962 United Kingdom .

*Primary Examiner*—Gerald A. Michalsky
*Attorney, Agent, or Firm*—Oblon, Spivak, McClelland, Maier & Neustadt

[57] ABSTRACT

A submergible motor pump including a vortex impeller attached to an end of a motor shaft, a pump casing attached to a motor casing and accommodating the impeller therein, a strainer attached to the pump casing for introducing water to be sucked into the pump casing, and a bottom plate supporting the strainer from therebelow is disclosed. The pump casing comprises an intermediate casing member and a lower casing member, which are detachable from each other. The pump casing has a configuration in which the upper side is open so that the flow passage formed in the lower casing member does not have a bag-shaped configuration. A plurality of legs are provided on the lower side of the lower casing member as being integral portions thereof. The legs are spaced apart from each other and extend as far as the outer peripheral end of the lower casing member. The strainer is provided around the outer peripheral end of the lower casing member in such a manner as to surround the outer periphery of the lower casing member. The lower casing member is clamped betwen the bottom plate and the intermediate casing member by means of clamping bolts, thereby assembling together the bottom plate, the lower casing member and the strainer in one unit.

24 Claims, 24 Drawing Sheets

Fig.16A
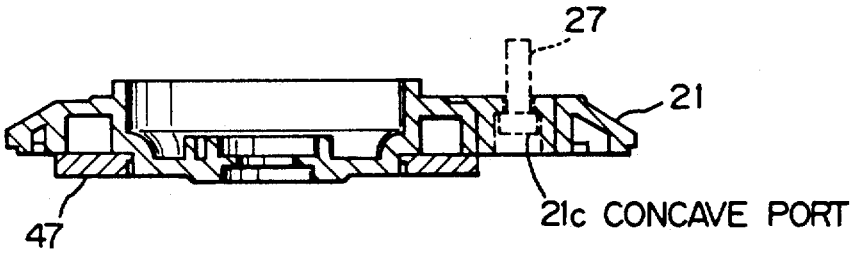
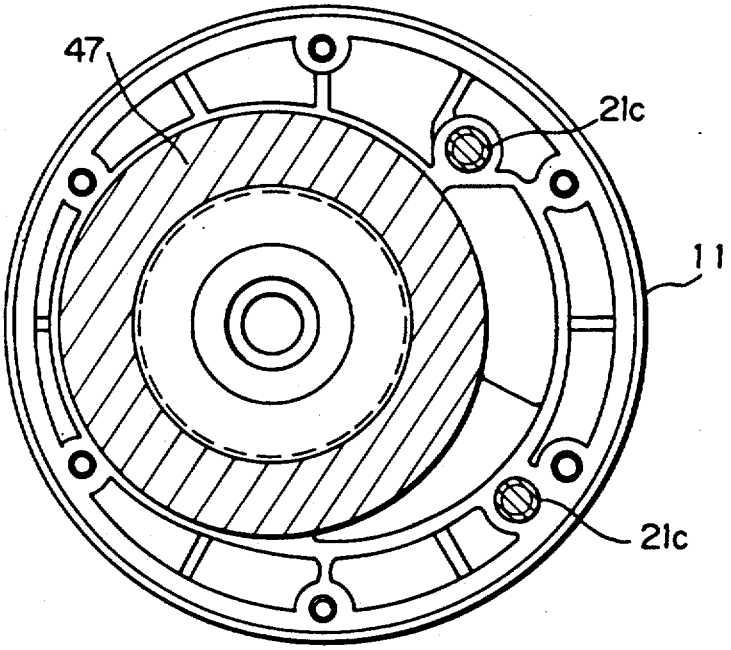
Fig. 16B

Fig.22A
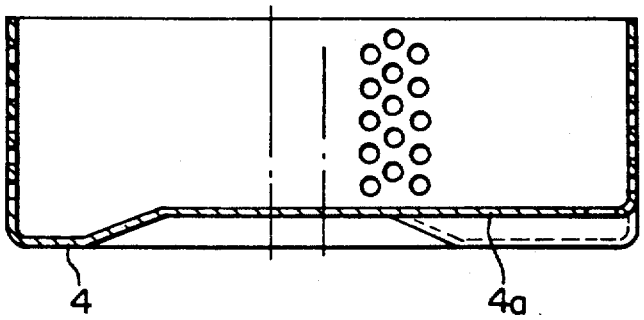
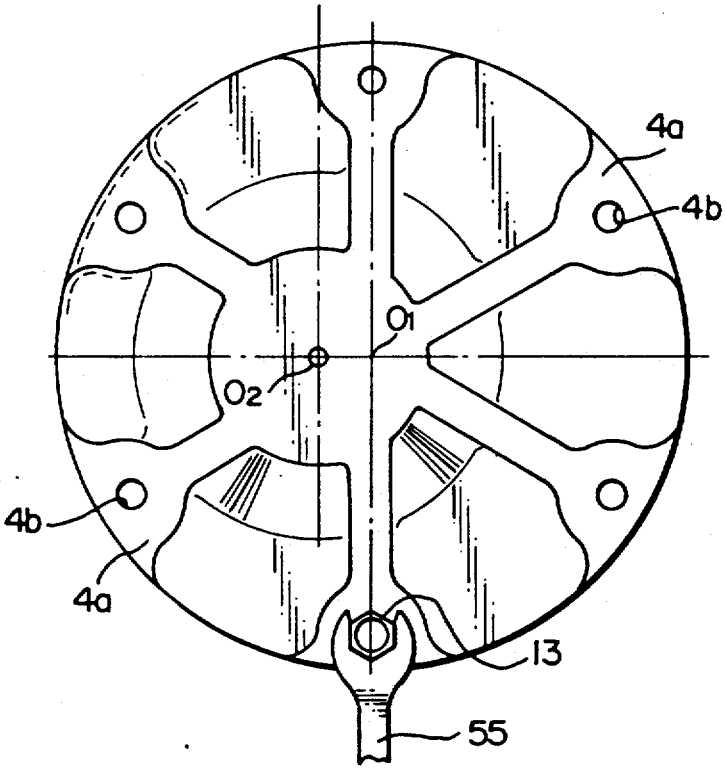
Fig.22B

Fig. 23A
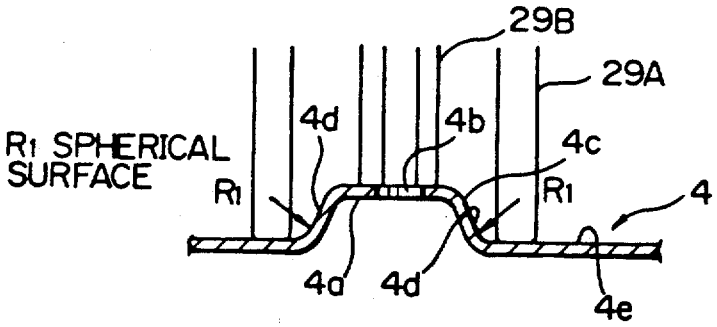
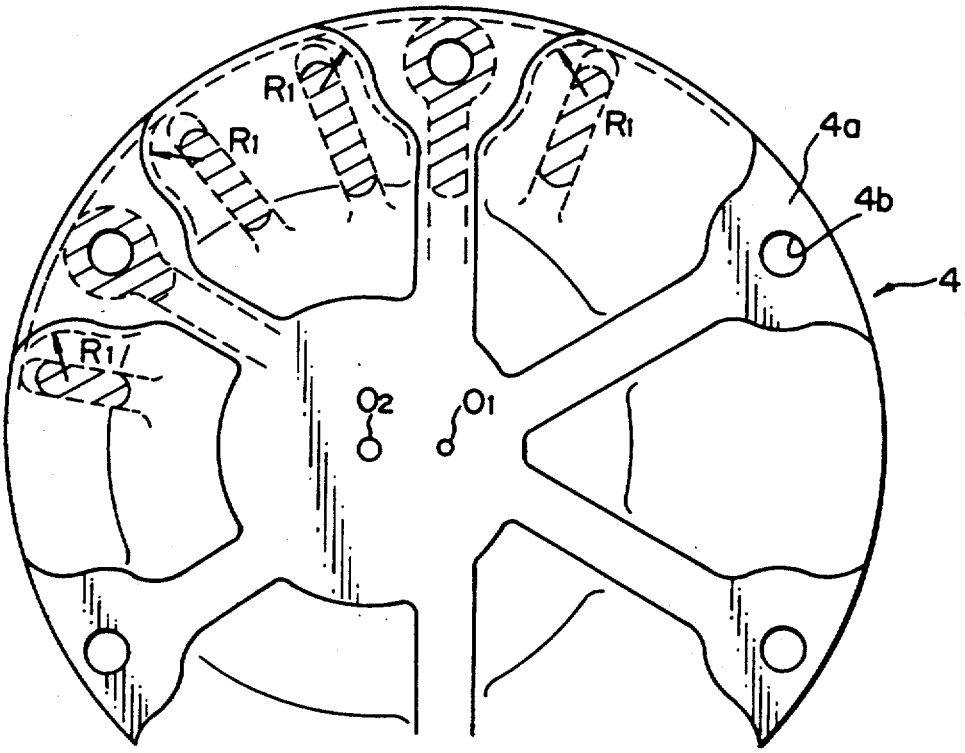
Fig. 23B

SUBMERGIBLE MOTOR PUMP

BACKGROUND OF THE INVENTION

1. Field of the Invention:

The present invention relates to a submergible motor pump which is mainly used for construction work, the pump having a vortex impeller attached to an end of a motor shaft. More specifically, the present invention relates to a submergible motor pump having a relatively wide gap in front of the impeller, thereby enabling foreign substances, for example, sands, to be discharged, together with a vortex generated in the space defined by the wide gap when the pump is operated.

2. Prior Art:

A conventional submergible motor pump which is mainly used for construction work is arranged as shown in FIG. 1. A semiopen impeller 1 which has no forward shroud but only a main shroud at the back side is attached to an end portion of a motor shaft 3 and accommodated in a pump casing 5 comprising an intermediate casing member (bracket) and a lower casing member, which are formed together in an integral structure, and a suction cover 7 is mounted at the suction side with a minute gap $S_1$ (1 to 2 mm) provided between the same and the forward end face of the impeller 1. A bottom plate 11' is mounted by means of a bolt 13' below the suction cover 7 through a cylindrical strainer 9'. In the figure, reference numerals 15 and 17 denote a mechanical seal and a lubricating oil, respectively.

In operation, a fluid that is sucked in through the strainer 9' in response to the rotation of the impeller 1 is raised in pressure by the action of the impeller 1 and discharged to the outside through a flow passage 19.

The conventional submergible motor pump described above, however, involves the following problems:

(i) It is necessary to precisely adjust the minute gap $S_1$ for the impeller 1, making maintenance difficult and time consuming.

(ii) To form the flow passage 19 inside the pump casing 5, a core 19*a* is needed for the casting process, as shown in FIG. 2(*b*). In addition, as shown in FIG. 2(*a*), a large number of portions (indicated by the mark ∇ in the figure) require machining. Accordingly, a great deal of labor is required for shaping and machining operations.

(iii) It has heretofore been impossible to produce the pump casing 5 using a wear-resistant material, for example, an elastomeric material, from the configurational point of view.

(iv) Since the impeller 1 is installed in the inner part of the pump casing 5, it is difficult to remove the impeller 1 for replacement even if the suction cover 7 is removed, as shown in FIG. 3, and a special jig must be employed to remove the impeller 1.

(v) To replace the pump casing 5 which has become worn, the mechanical seal 15, even if it is in good condition, must be removed.

(vi) It is also necessary to discard the lubricating oil 17 when the pump casing 5 is replaced.

SUMMARY OF THE INVENTION:

It is, therefore, an object of the present invention to provide a submergible motor pump which is easy to assemble and disassemble and may be easily and efficiently maintained and manufactured.

Another object of the present invention is to provide a submergible motor pump which enables the use of a wear-resistant material such as an elastomeric material as a material of the pump casing.

A further object of the invention is to provide a submergible motor pump from which it is easy to remove and replace the impeller.

A still further object of the present invention is to provide a motor pump which does not require the mechanical seal to be removed or the lubricating oil to be discarded during replacement of the pump casing.

To attain the above-described object, the present invention provides a submergible motor pump having a vortex impeller attached to an end of a motor shaft, comprising: a pump casing comprising an intermediate casing member and a lower casing member, which are detachable from each other, the pump casing having a configuration in which the upper side is open so that the flow passage formed in the lower casing member does not have a bag-shaped configuration; a plurality of legs provided on the lower side of the lower casing member as being integral portions thereof, the legs being spaced apart from each other and extending as far as the outer peripheral end of the lower casing member; and a strainer provided around the outer peripheral end of the lower casing member in such a manner as to surround the outer periphery of the lower casing member, the lower casing member being clamped between a bottom plate supporting it from below and the intermediate casing member by means of clamping bolts, thereby assembling together the bottom plate, the lower casing member and the strainer in one unit.

In a preferred embodiment of the invention, the head of a bolt used to attach the intermediate casing member to the lower end of the motor casing projects toward the lower casing member, which is provided with a recess so that the bolt head fits therein with a narrow gap therebetween.

Also, the lower casing member is preferably made of an elastomeric material.

In the present invention having the above-described arrangement, since the impeller is of the vortex type in which the main shroud is disposed in close proximity to the intermediate casing member to provide a relatively wide gap in front of it, foreign substances, for example, sand, are carried out together with a vortex generated in the wide space defined in front of the impeller during a pumping operation. Accordingly, adjustment of a minute gap for the impeller is unnecessary and wear of the impeller is minimized.

Since the pump casing comprises the intermediate casing member and the lower casing member, which are detachable from each other, inspection and replacement of the impeller are facilitated. The lower casing member can be replaced independently of the mechanical seal and the lubricating oil, and maintenance is therefore facilitated.

Since the lower casing member, which is a detachable member, has a configuration in which the upper side is open, it can be produced from an elastomeric material without the need for a core for casting or machining process. Thus, productivity can be increased.

The lower casing member has legs which are integral with the lower side thereof and which extend as far as the outer peripheral end thereof, a strainer is mounted around the outer peripheral end of the lower casing member, and the lower casing member being clamped between the bottom plate and the intermediate casing member and assembled together by means of clamping bolts. It is therefore possible to form a pump casing having a pressure-resistant structure by use of standard parts such as bolts and strainer. Accordingly, a satisfactory pressure-resistant structure is obtained even if the lower casing member is made of an elastomeric material, and the elastomeric material can therefore be made relatively soft. Thus, by forming the lower casing member using an elastomeric material, it is possible to improve wear resistance of the casing and reduce the weight thereof.

When the head of a bolt used to attach the intermediate casing member to the lower end of the motor casing is fitted in a recess provided in the lower casing member, expansible deformation of the lower casing member is prevented by this bolt head. By this arrangement, it is also possible to facilitate the positioning of the lower casing member with respect to the intermediate casing member when the parts are assembled together.

The above and other objects, features and advantages of the present invention will become more apparent from the following description when taken in conjunction with the accompanying drawings in which a preferred embodiment of the present invention is shown by way of illustrative examples.

BRIEF DESCRIPTION OF THE DRAWINGS

FIGS. 4 to 9 inclusive show a first embodiment of the present invention and wherein:

FIG. 4 is a longitudinal sectional view of a first embodiment of the submergible motor pump according to the present invention;

FIG. 5 is a plan view of the lower casing member;

FIG. 6 is a bottom view of the lower casing member;

FIGS. 7(*a*) and 7(*b*) respectively are plan and longitudinal sectional views employed to illustrate a lower casing member made of an elastomeric material;

FIGS. 8(*a*), 8(*b*) and 8(*c*) are sectional views employed to explain the function of the first embodiment;

FIG. 9 shows the submergible motor pump of the first embodiment which is in a disassembled state;

FIGS. 10 to 12 inclusive show a second embodiment of the present invention and wherein:

FIG. 10 is a longitudinal sectional view of the lower half of the submergible motor pump showing a second embodiment of the present invention;

FIGS. 11(*a*), 11(*b*) and 11(*c*) respectively are a longitudinal sectional view of an upper casing member, a plan view of the same, and a partial sectional view of the same;

FIGS. 12(*a*) and 12(*b*) respectively are a cross-sectional view of a lower casing member, and a longitudinal sectional view of the same;

FIGS. 13 to 16 inclusive show a third embodiment of the present invention and wherein:

FIG. 13 is a longitudinal sectional view of a submergible motor pump showing third embodiment according to the present invention;

FIGS. 14(*a*) and 14(*b*) respectively are a top plan view and a sectional view showing a relationship between a resilient ring and a lower casing member, and a flow of water upon operation;

FIGS. 15(*a*) and 15(*b*) respectively are a top plan view of the lower casing member and a sectional view of the same;

FIGS. 16(*a*) and 16(*b*) respectively are a sectional view of an intermediate casing member and a bottom plan view of the same;

FIGS. 17 to 19 inclusive show a fourth embodiment of the present invention and wherein:

FIG. 17 is a longitudinal sectional view of a submergible motor pump showing fourth embodiment of the present invention;

FIGS. 18(*a*) and 18(*b*) respectively are a partly longitudinal sectional view of the motor pump and a bottom plan view of a lower casing member, showing the water flow on operation;

FIG. 19 is a partly sectional view of the motor pump showing a dimensional relationship of a strainer;

FIGS. 20 to 24 inclusive show a fifth embodiment of the present invention and wherein:

FIG. 20 is a longitudinal sectional view of the submergible motor pump showing a fifth embodiment of the present invention;

FIGS. 21(*a*) and 21(*b*) respectively are a longitudinal sectional view of the lower casing member and a bottom plan view of the same;

FIGS. 22(*a*) and 22(*b*) respectively are a longitudinal sectional view of a strainer and a bottom plan view of the same;

FIGS. 23(*a*) and 23(*b*) respectively are a partly cross-sectional view of a lower casing member and strainer assembled in unity and a bottom view of the same; and FIGS. 24(*a*) and 24(*b*) are longitudinal sectional views of a lower casing member and strainer upon assembling operation thereof.

DETAILED DESCRIPTION OF THE PREFERRED EMBODIMENTS

A first embodiment of the present invention will be described below with reference to FIGS. 4 to 9.

Figure 4:
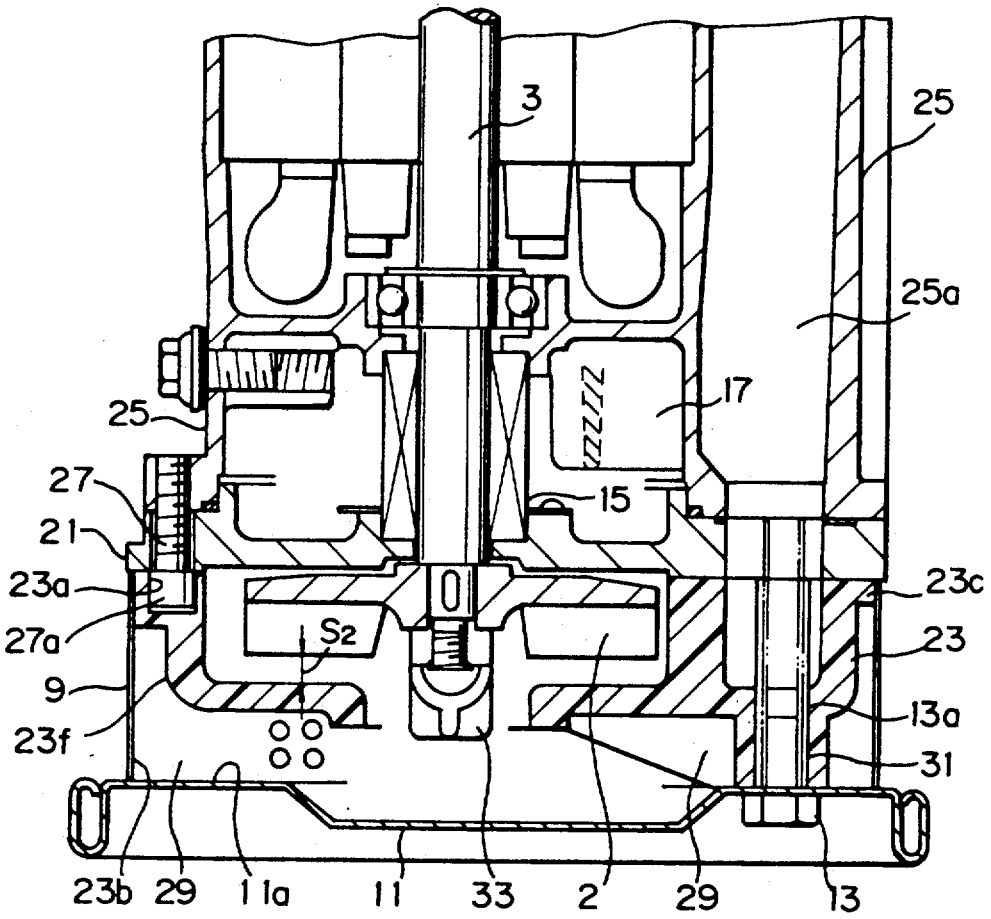

FIG. 4 is a longitudinal sectional view of first embodiment of the submergible motor pump according to the present invention. It should be noted that in all the figures the same reference numerals denote the same or like portions.

Figure 1:
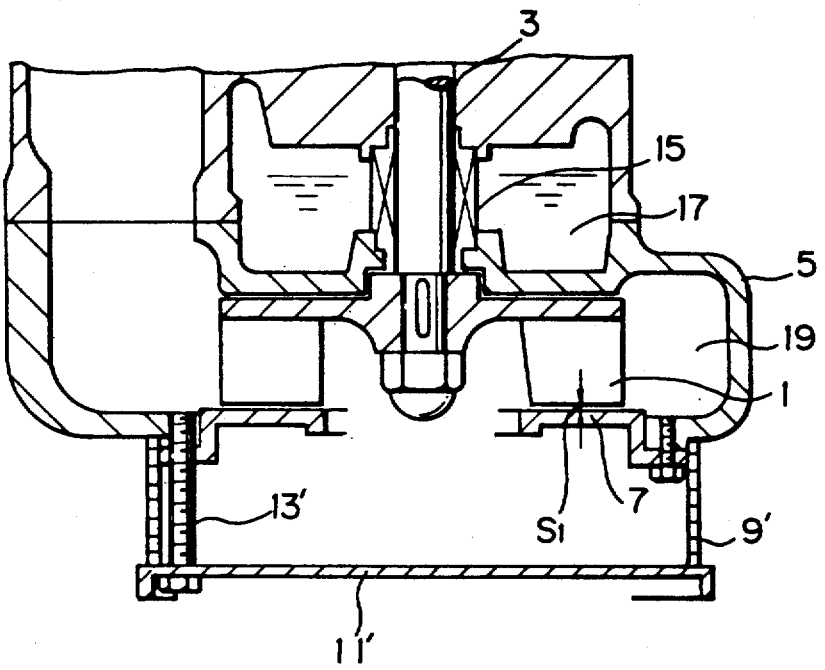
Fig. 1 PRIOR ART
FIG. 1 is a longitudinal sectional view of a prior art submergible motor pump.
Figure 2A:
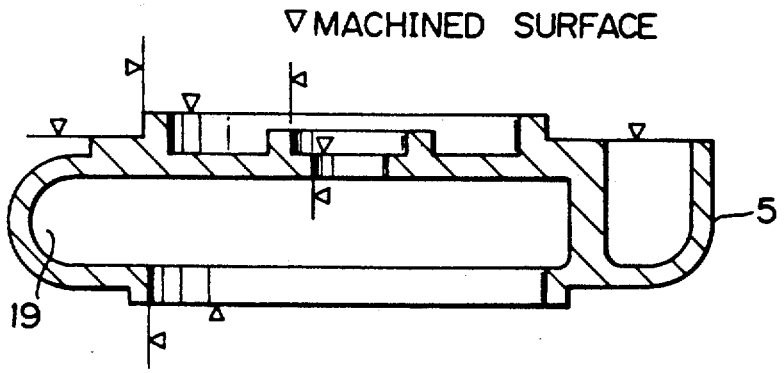
Fig.2A PRIOR ART
FIGS. 2(*a*) and 2(*b*) show a method of producing the pump casing of the prior art.
Figure 2B:
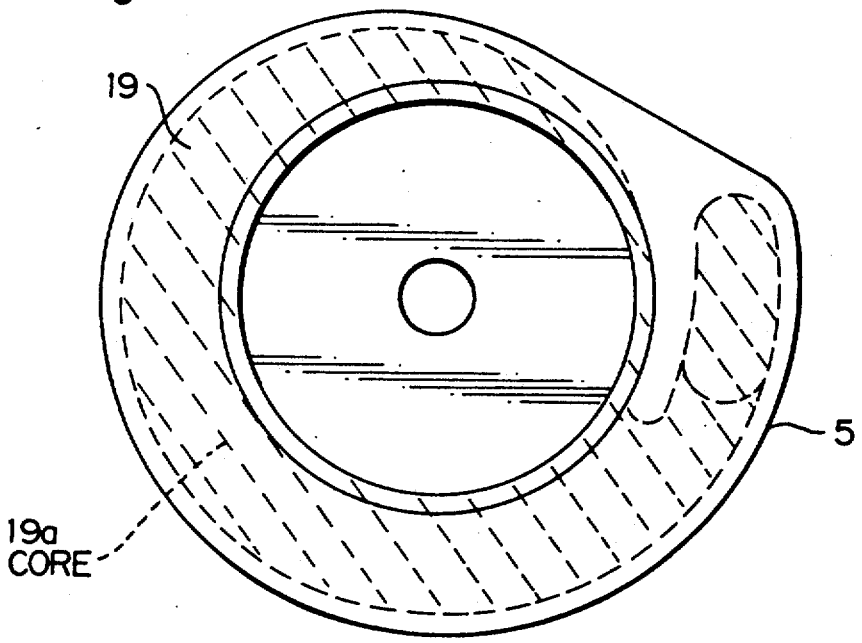
Fig.2B PRIOR ART
Figure 3:
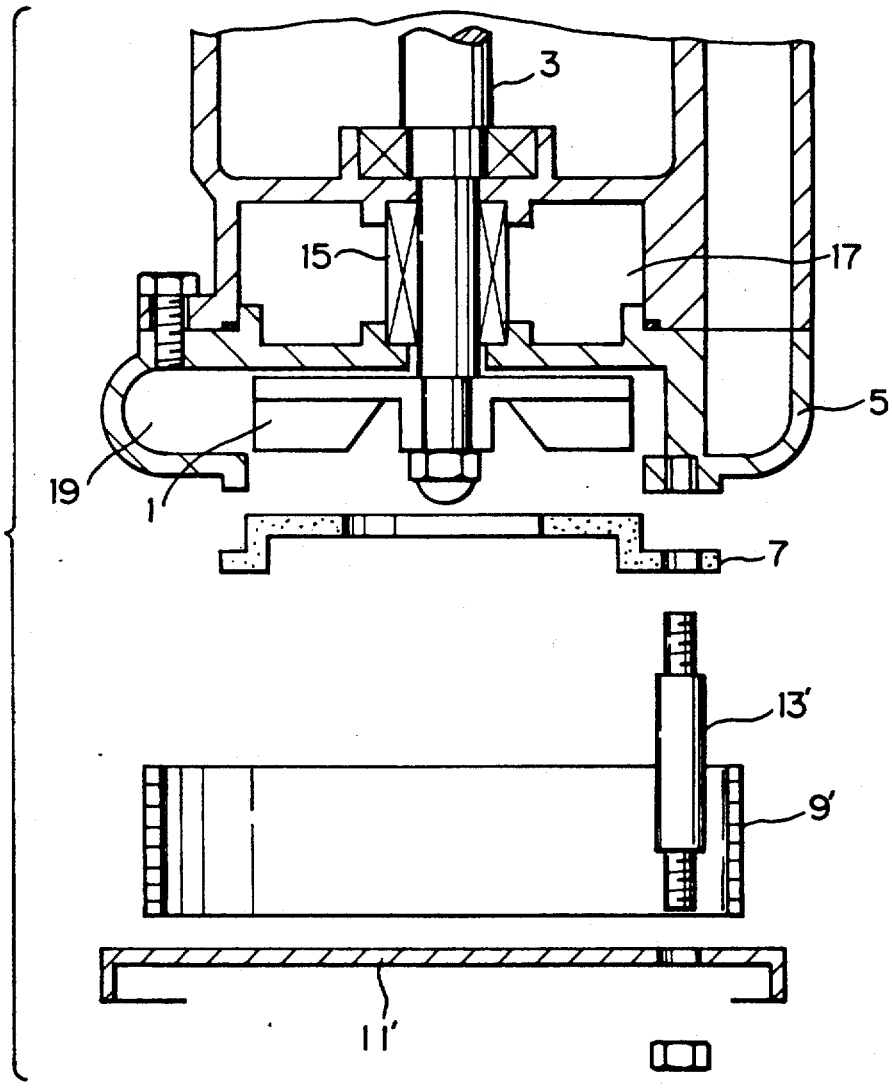
Fig.3 PRIOR ART
FIG. 3 shows the prior art submergible motor pump which is in a disassembled state.

Referring to FIG. 4, pump casing comprises an intermediate casing member (bracket) 21 and a lower casing member 23, which are detachable from each other. The intermediate casing member 21 is attached to a motor casing 25 by means of a bolt 27 in such a manner that the bolt head 27*a* is buried, with a narrow gap, in a recess 23*a* formed in the upper surface of the lower casing member 23. The lower casing member 23 is made of an elastomeric material such as a rubber and has an integral portion which serves as the suction cover 7 (see FIG. 1) of the prior art.

Figure 6:
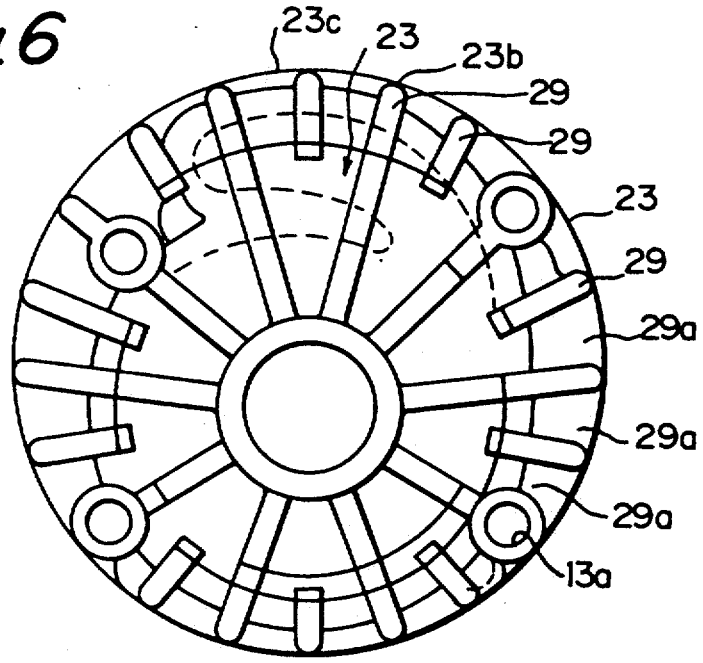

The lower casing member 23 has a plurality of legs 29 formed integral with the lower side (lower surface) thereof, the legs 29 radially extending as far as the outer peripheral end 23*b* of the lower casing member 23, as shown in FIG. 6.

A strainer 9 is mounted around the lower casing member 23 in such a manner that the strainer 9 surrounds the whole side surface of the lower casing member 23. A bottom plate 11 supports the strainer 9 and the lower casing member 23 from below them. A bolt 13 extends through a hole 13*a* which extends through a leg 29 and the lower casing member 23, and the bolt 13 is screwed into the intermediate casing member 21, thereby installing the lower casing member 23, the strainer 9 and the bottom plate 11 together in one unit.

A vortex impeller 2 is mounted inside a pump casing chamber defined by the intermediate casing member 21 and the lower casing member 23, with the main shroud being disposed back in the vicinity of the lower surface of the intermediate casing member 21, thereby providing a relatively wide gap $S_2$ in front of the impeller 2 (below the impeller 2, as viewed in FIG. 4), so that foreign substances, for example, sand, are carried out together with a vortex generated in the space defined with the gap $S_2$ when the pump is operated, and thus minimizing the wear of the impeller 2. In this way, a so-called vortex pump is formed.

It should be noted that reference numeral 31 in FIG. 4 denotes a sleeve which is inserted into the bolt receiving hole 13*a* to adjust the interference of the lower casing member 23 and the relevant leg 29, which are made of an elastomeric material and therefore deformed when clamped by the bolt 13. Reference numeral 33 denotes an impeller nut for preventing air lock.

Figure 8A:
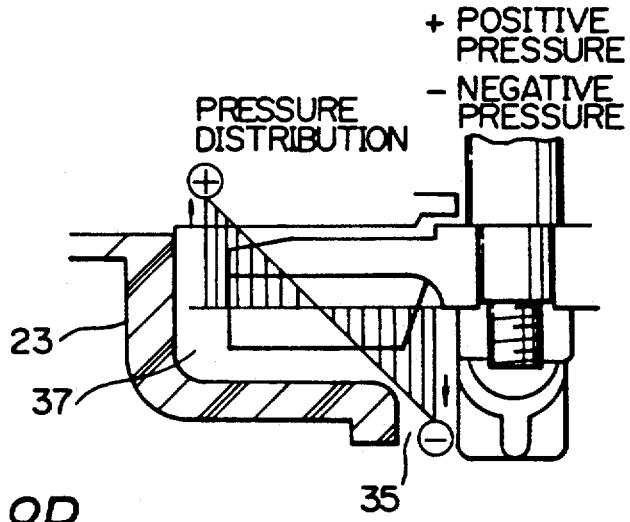
Figure 8B:
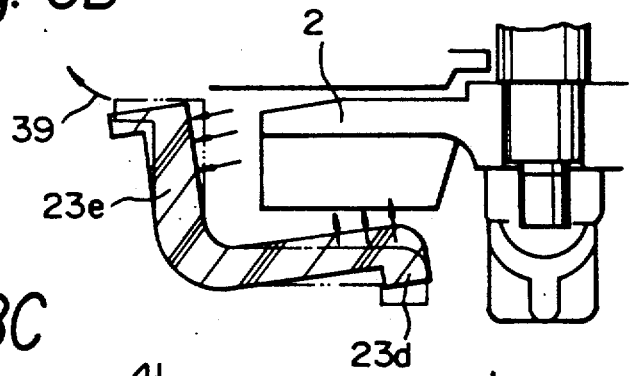
Figure 8C:
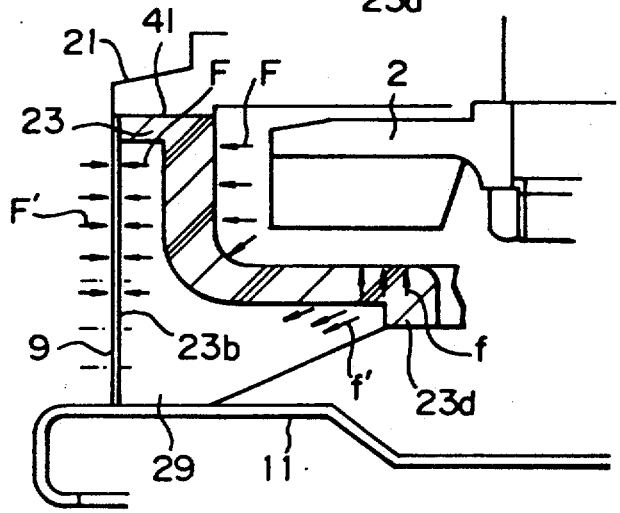

The function of the first embodiment will next be explained:

(i) In general, when a pump which has a lower casing member 23 made of an elastomeric material such as rubber is operated, the pressure distribution over a longitudinal section inside the casing is such that the pressure is negative at the suction side 35 and positive at the outer periphery 37 of the inside of the pump, as shown in FIG. 8(*a*). In consequence, the lower casing member 23 made of an elastomeric material is deformed such that the suction port portion 23*d* is sucked into the pump chamber, while the pump outer wall 23*e* is pressed outwardly, as shown in FIG. 8(*b*). As a result, the suction port portion 23*d* may collide with the impeller 2, and the deformation of the outer wall 23*e* may cause the pumped fluid to leak out, as shown by the arrow 39. To prevent such an occurrence, it has been considered to add a special compounding agent to the elastomeric material in order to increase the hardness of the rubber or to increase the thickness of the wall of the lower casing member 23, with a view to preventing deformation of the lower casing member 23. However, as is generally known, if the level of hardness is increased, wear resistance is lowered, and if the wall thickness increases, the cost of material rises.

In contrast, the pump according to this embodiment has a plurality of radial legs 29 formed integral with the lower side of the lower casing member 23 made of an elastomeric material in such a manner that the legs 29 extend as far as the outer peripheral end 23*b* of the lower casing member 23, and the lower casing member 23 is clamped between the intermediate casing member 21 and the bottom plate 11. Accordingly, a suction force f creates a reaction force acting in the direction indicated by the arrows f', which prevents the suction port portion 23*d* from being sucked into the pump chamber, as shown in FIG. 8(*c*).

(ii) As stated above, the strainer 9 is installed around the lower casing member 23 in such a manner that the strainer 9 surrounds the whole side surface of the lower casing member 23. Accordingly, the strainer 9 receives the expansile force F acting on the lower casing member 23 due to the pressure therein and prevents the deformation of the lower casing member 23 by the reaction force F'. These deformation preventing functions operate in conjunction with each other to prevent leakage through the area 41 of sealing between the lower casing member 23 and the intermediate casing member 21 [FIG. 8(*c*)].

(iii) In addition, the bolts 13 that clamp the lower casing member 23 are received through the respective through-holes 13*a* in the lower casing member 23 and screwed into the intermediate casing member 21. Accordingly, the bolts 13 internally prevent the expansion of the lower casing member 23 caused by the pressure inside the pump chamber.

Figure 4A:
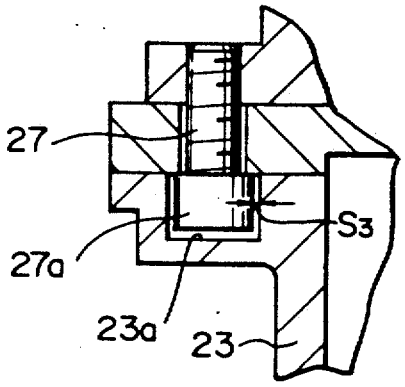
FIG. 4A is an enlarged sectional view of an essential part of the embodiment.
Figure 5:
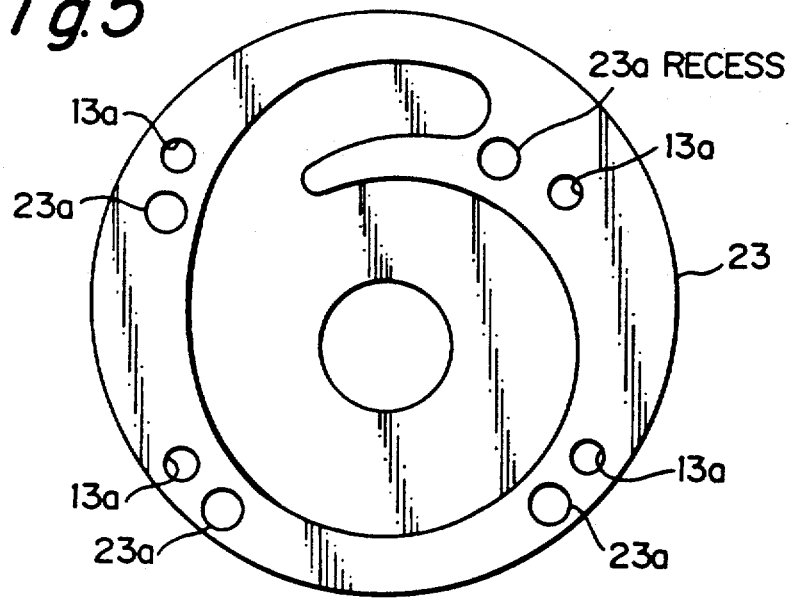

Further, the bolt 27 that is used to attach the intermediate casing member 21 to the motor casing 25 is disposed such that the bolt head 27*a* projects toward the lower casing member 23 and is inserted (fitted) into the recess 23*a* provided in the lower casing member 23 with the narrow gap $S_3$ therebetween, as shown in the enlarged view of FIG. 4A, thereby preventing the expansile deformation of the lower casing member 23.

(iv) Since a suction passage of the pump is defined by the spaces 29*a* (FIG. 6) between the legs 29 formed integral with the lower side of the lower casing member 23 and the outer surface 23*f* (FIG. 4) of the lower casing member 23 and the upper surface 11*a* of the bottom plate 11, the whole strainer 9 that is disposed around the lower casing member 23 serves to provide the effective suction area of the pump when operated. Moreover, since the strainer 9 surrounds the whole lower casing member 23 as described above, it is possible for the strainer 9 to have a relatively large outer diameter, i.e. effective area. Accordingly, even if clogging with foreign matter occurs, there is no lowering in the pump's performance since the pump has a sufficiently large effective area.

Figure 9:
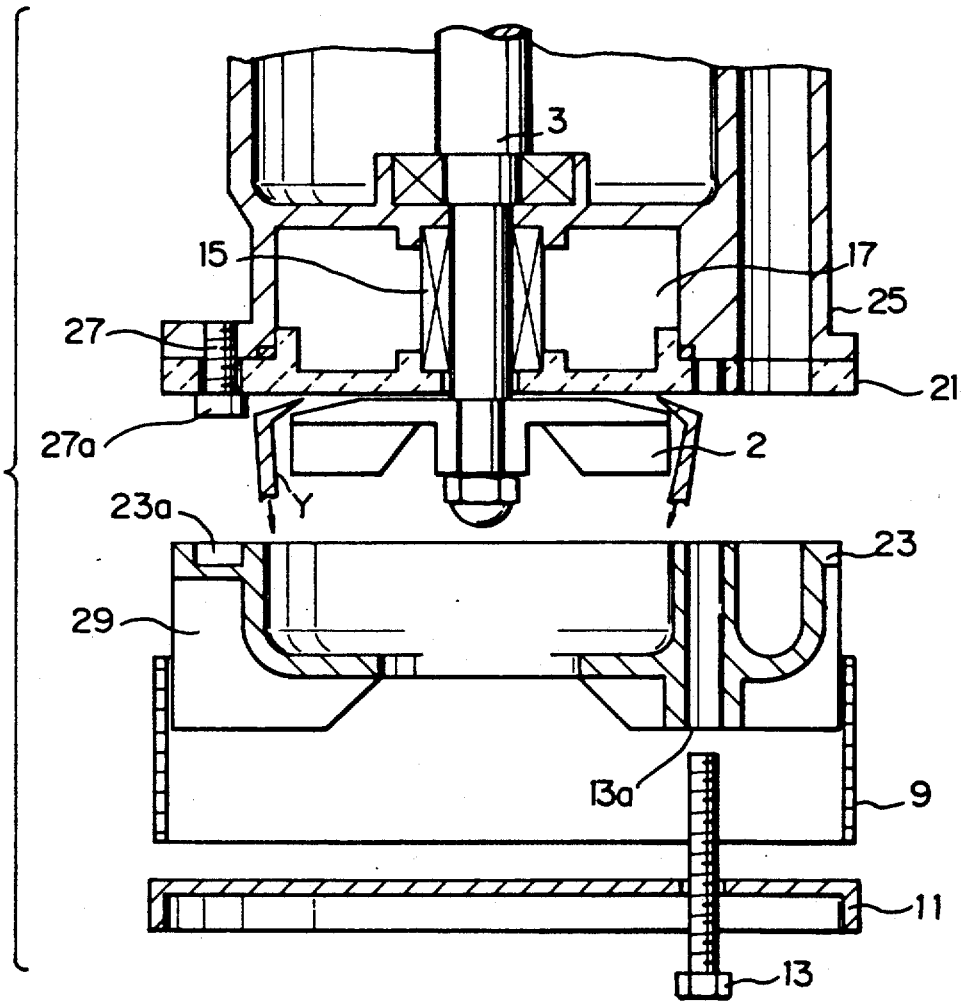

(v) The submergible motor pump can easily be disassembled into the bottom plate 11, the lower casing member 23 and the strainer 9 simply by removing the clamping bolts 13, as shown in FIG. 9. By removing these parts, the whole impeller 2 can be inspected. When the impeller 2 is to be replaced, it can be readily removed by inserting a commercially available removing tool Y into the area at the back of the main shroud of the impeller 2, as shown in FIG. 9, and pulling the tool Y in the arrowed direction.

(vi) In addition, the lower casing member 23 which has become worn can be replaced without removing the mechanical seal 15 nor throwing away the lubricating oil 17.

When the parts are assembled together, the head 27*a* of the bolt 27 mounting the intermediate casing member 21 is engaged with the recess 23*a* in the lower casing member 23 in the form of socket, thereby enabling the bolt holes 13*a* in the lower casing member to be readily positioned with respect to the corresponding bolt holes in the intermediate casing member 21. Thus, the time required for assembling is shortened.

Figure 7A:
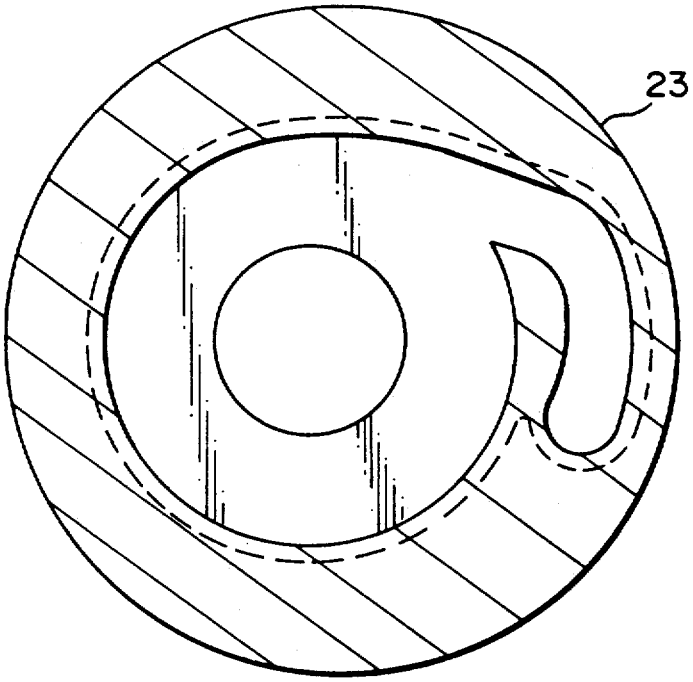
Figure 7B:
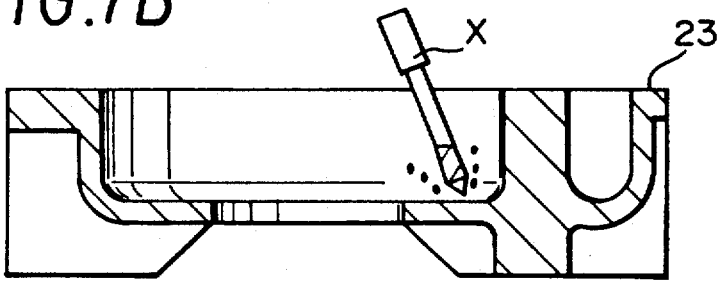

In short, the foregoing embodiment provides the following advantageous effects:

(i) Since the lower casing member 23 has an open configuration in which the upper side is open, it can be produced by casting without the need for a core, and the productivity is therefore improved. Removal of scale deposited on the lower casing member 23 can be effected for the whole flow passage with a descaling tool X from the upper side thereof, as shown in FIG. 7(*b*). Since the lower casing member 23 and the strainer 9 are detachable from the motor casing 25 as a unit member, assembly and disassembly of the casing is facilitated.

(ii) Even if the lower casing member 23 is made of an elastomeric material, expansile deformation due to internal pressure acting upon the lower casing member 23 can be prevented by use of standard parts such as the bottom plate 11, the bolts 13, 27 and the strainer 9, and thus a pressure-resistance structure is obtained. Accordingly, the elastomeric material can be made relatively soft and it is therefore possible to improve its wear resistance. Therefore, a reduction in weight is also achieved.

(iii) Since the pump casing has a splittable structure comprising the intermediate casing member 21 and the lower casing member 23, it is easy to inspect or replace the impeller 2, and handling of the casing is facilitated. In addition, the lower casing member 23 can be replaced independently of the mechanical seal 15 and the lubricating oil 17, and maintenance of the pump is therefore facilitated.

Although in the first embodiment, the strainer 9 and the bottom plate 11 are separately provided, they can constitute a single element, i.e., a strainer having a bottom plate, which will be referred to hereunder concerning other embodiments.

Figure 10:
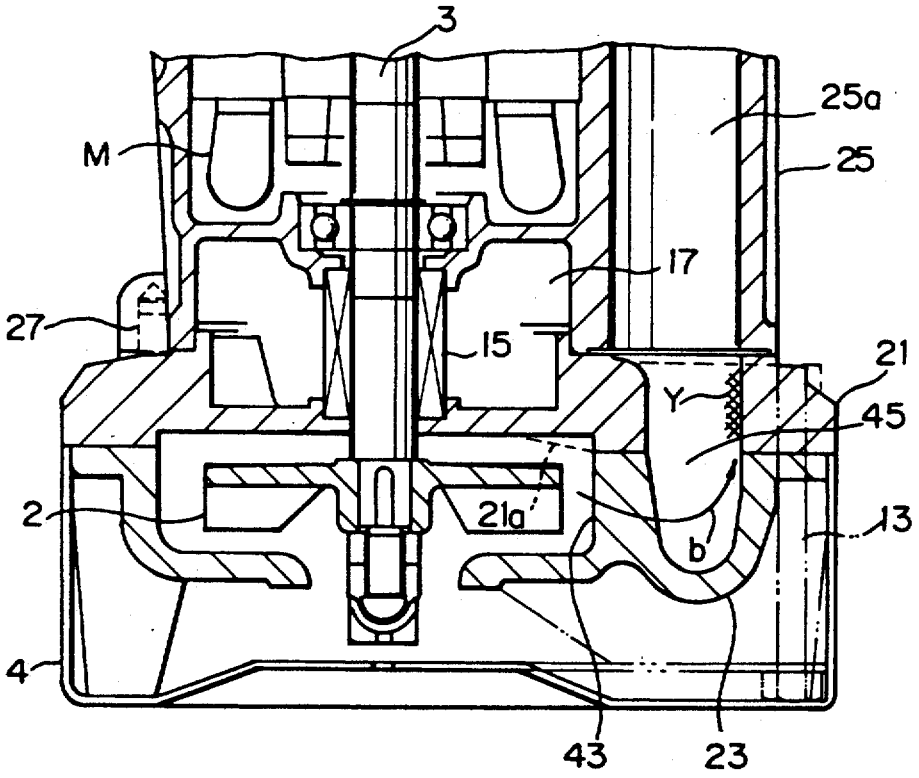
Figure 11A:
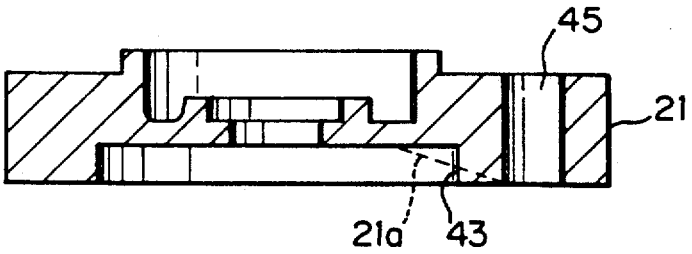
Figure 11B:
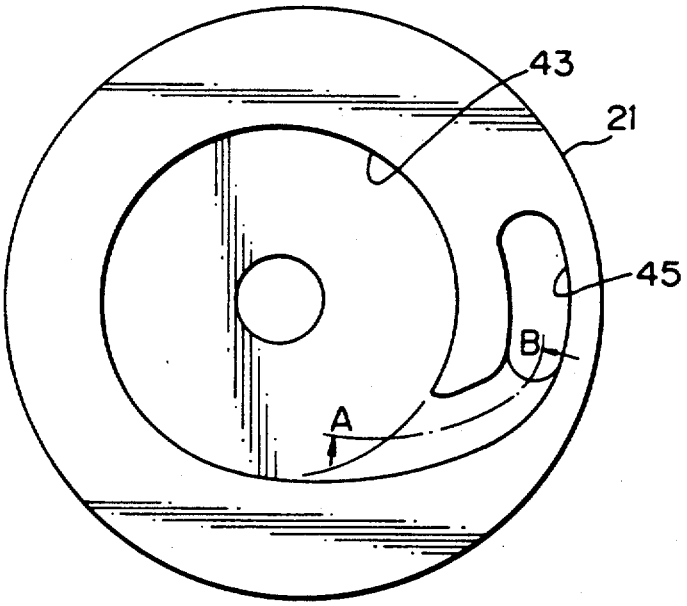
Figure 11C:
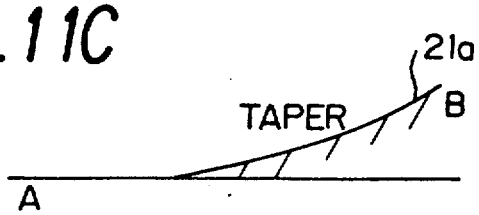
Figure 12A:
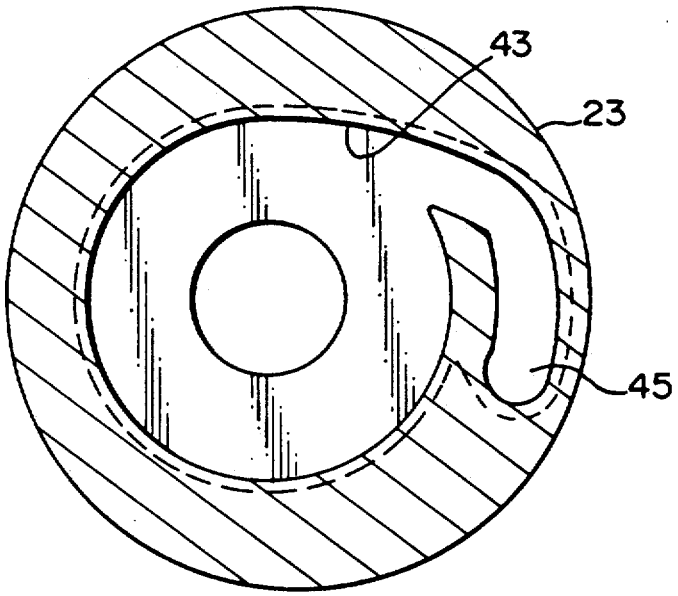
Figure 12B:
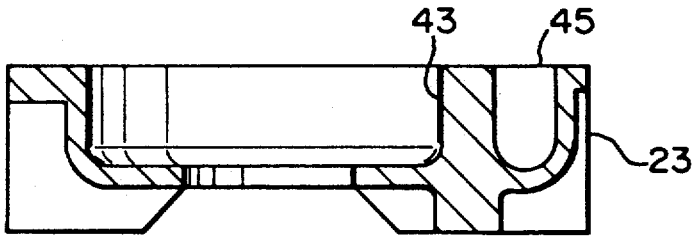
Figure 13:
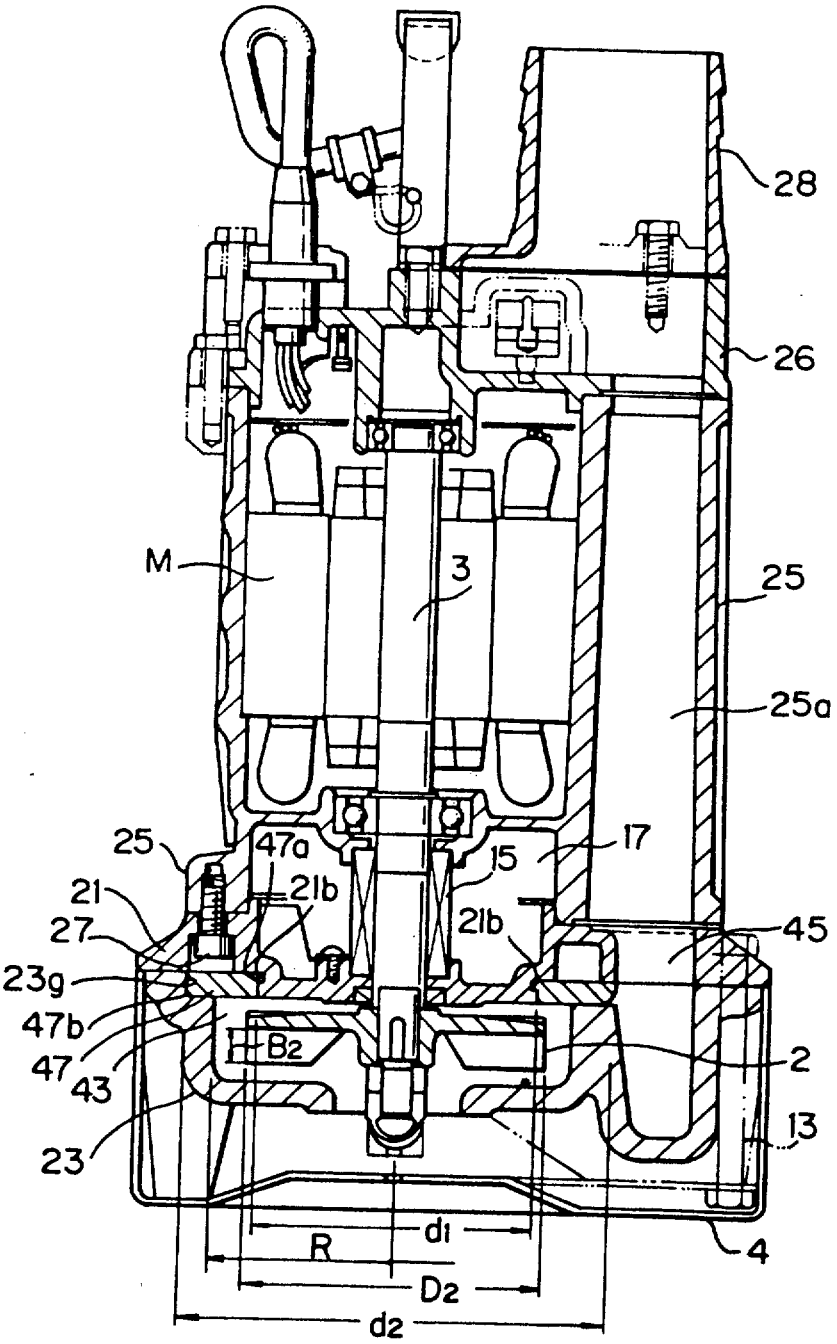

FIGS. 10 to 12 show a second embodiment of the present invention.

In this embodiment, a slope or tapered portion 21*a* descending gradually toward the water flow direction, is provided in a channel from the volute portion 43 of the intermediate casing member 21 to the discharge port 45 as shown in FIGS. 11(*a*), (*b*) and (*c*) [FIG. 11(*c*) is a partial cross-sectional view taken substantially on line A-B in FIG. 11(*b*)].

Thus, in this embodiment, when the water is discharged from the volute portion 43 to the discharge port 45, the water is guided along the slope portion 21*a* provided at the bottom surface of the intermediate casing member 21 to gradually descend to the lower direction, and then it is converted into the upper direction in the discharge port 45 as indicated by an arrow b, and flows into the discharge channel 25*a* of the motor casing 25 via the discharge port 45.

In this arrangement, since a position where the water flow is converted into the upper direction in the discharge port 45, is lower in comparison with the first embodiment, a position Y on the inner surface of the channel, which is worn away by the action of foreign matter, such as sand, in the water, can be lowered to the area in the intermediate casing member 21, as shown in FIG. 10.

Consequently, abrasion at the discharge channel 25*a* of the motor casing 25 can be eliminated or greatly reduced and the motor casing 25 can therefore have improved durability.

When the arrangement of the embodiment as described above is applied to submergible motor pumps of other types, such as so-called external motor pump or internal motor pump, other part located upper than an intermediate casing member 21, for instance, a hose coupling for an external motor pump or an outer barrel for an internal motor pump can be reduced in abrasion, respectively.

FIGS. 13 to 16 show a third embodiment of the present invention.

In this embodiment, similar to the first and second embodiments, a discharge channel 25*a* is formed in the motor casing 25 to enable cooling of the motor M by the water (fluid) discharged from the impeller 2, which flows along the outer side of the motor M and is discharged from a hose coupling 28 to the outside via a motor cover 27 which also functions as a cooling room of the motor.

In this embodiment, a resilient ring 47 is provided on the lower surface of an intermediate casing member 21 to cover and seal a bolt 27 from a water flow, which bolt fix the intermediate casing member 21 to a motor casing 25.

By this arrangement, the bolt 27 may be protected from the water without expanding the diameter of the intermediate casing member 21 and irrespective of the diameter of the volute portion 43 as compared with the first and second embodiments. Therefore, manufacturing of the intermediate and lower casing members 21, 23 may be made both more efficient and less expensive.

More specifically, an O ring-like projection 47*a* is provided on the inner diameter side of the resilient ring 47, and an annular groove 21*b* corresponding to the projection 47*a* is provided on the side of an intermediate casing member 21. These projection 47*a* and groove 21*b* are fit each other by force to fix the resilient ring 47 onto the intermediate casing member 21.

Figure 15A:
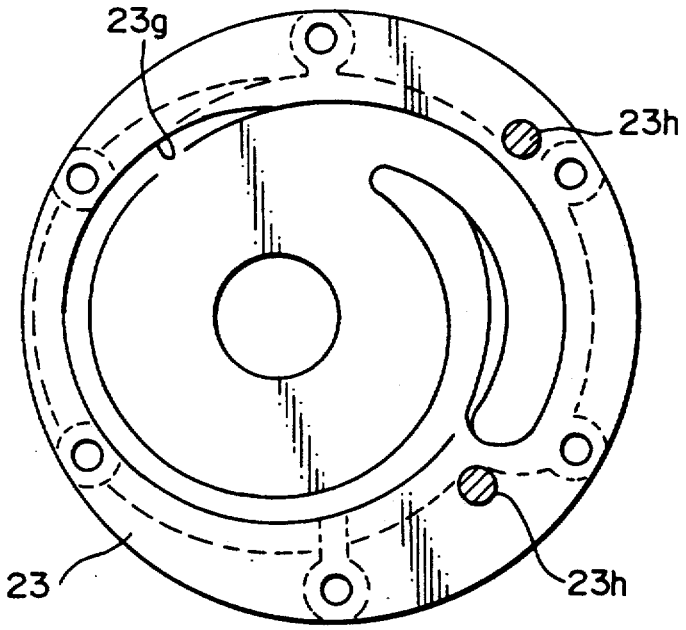
Figure 15B:
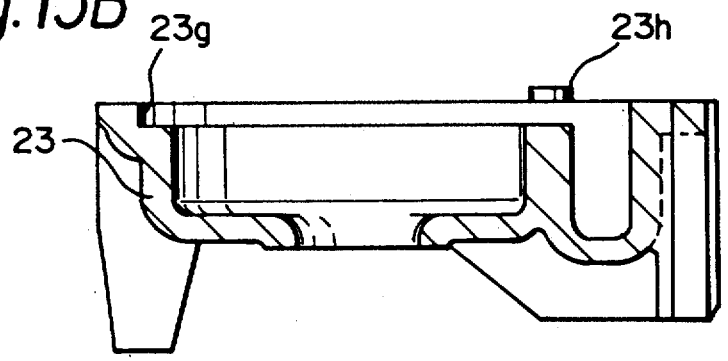

The outer circumferential portion of the ring 47 exposes from the intermediate casing member 21 and an engagement groove 23*g* for receiving the outer circumferential portion of the ring is, as shown in FIG. 15(*a*), provided on a lower casing member 23 to allow the easy positioning of the ring 47 onto the lower casing member 23. As shown in FIGS. 15(*a*), (*b*) and FIGS. 16(*a*), (*b*), a projection 23*h* corresponding to recess 21*c* which receives the bolts 27, but is not covered with the ring 47, is provided at the upper surface of the lower casing member 23. Thus, the fixture angle of the lower casing member 23 relative to the upper casing member 21 in the circumferential direction may easily be found.

Figure 14A:
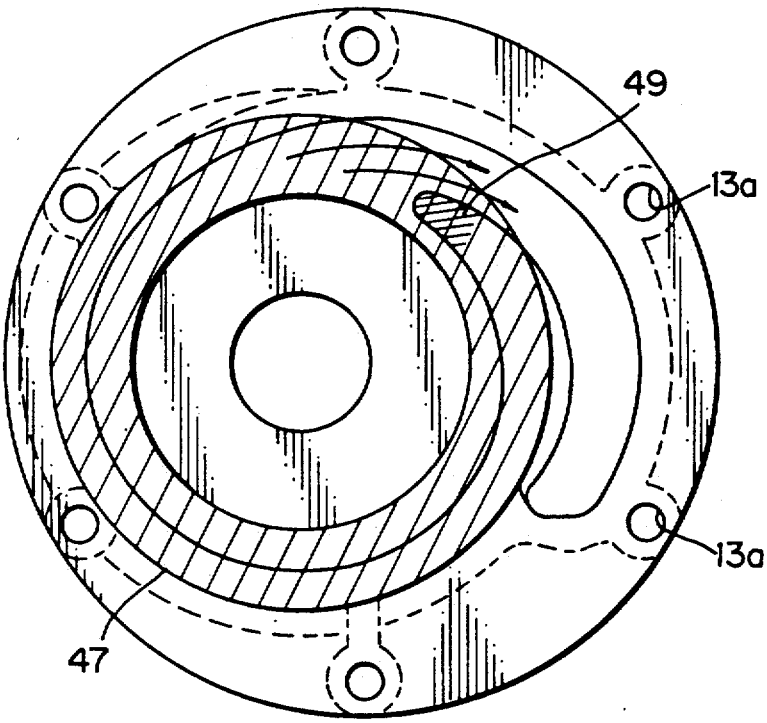
Figure 14B:
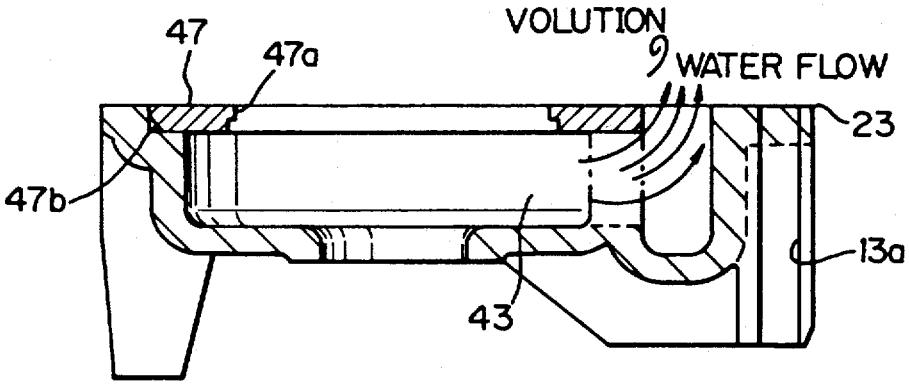

A taper-shaped chamfer 47*b* is provided on the lower surface of the outer circumferential part of the resilient ring 47 inserted onto the lower casing member 23 in order to make the water flow smooth as indicated by the arrow shown in FIGS. 14(*a*), (*b*), and goes into the discharge channel 25*a* of the motor casing 25 via the discharge port 45 of the intermediate casing member 21, and prevent the generation of a vortex flow in the discharge port 45. The chamfer 47*b* also facilitates the assembly of the resilient ring 47 onto the lower casing member 23.

In order to efficiently protect the lower surface of the intermediate casing member 21 which is readily subjected to abrasion due to the vortex flow generated by the impeller 2, and to prevent the deterioration in the cooling effect of the lubricant oil 17 through the wall of the intermediate casing member 21, the inner diameter $d_1$ of the resilient ring 47 is preferably $0.8\ D_2 \leqq d_1$. Also, in order to facilitate the positioning of the ring 47 on the lower casing member 23 and to avoid an excess increases in the diameter of the lower casing member 23, the outer diameter of the ring 47 is preferably $d_2 \leqq 1.2 \times (D_2 + 2B_2)$, where $B_2$ is the width of the blade of the impeller 2 and $D_2$ is the diameter of the same.

In addition, as shown in FIGS. 14(*a*), (*b*), the ring 47 is arranged to cover the volute water cutting edge portion 49 of the lower casing member 23, whereby the portion of the intermediate casing member 21 corresponding to the cutting edge portion, which is easily worn away, is prevented from being subjected to abrasion.

Thus, the replacement of the expensive intermediate casing member 21 can be generally avoided.

Figure 17:
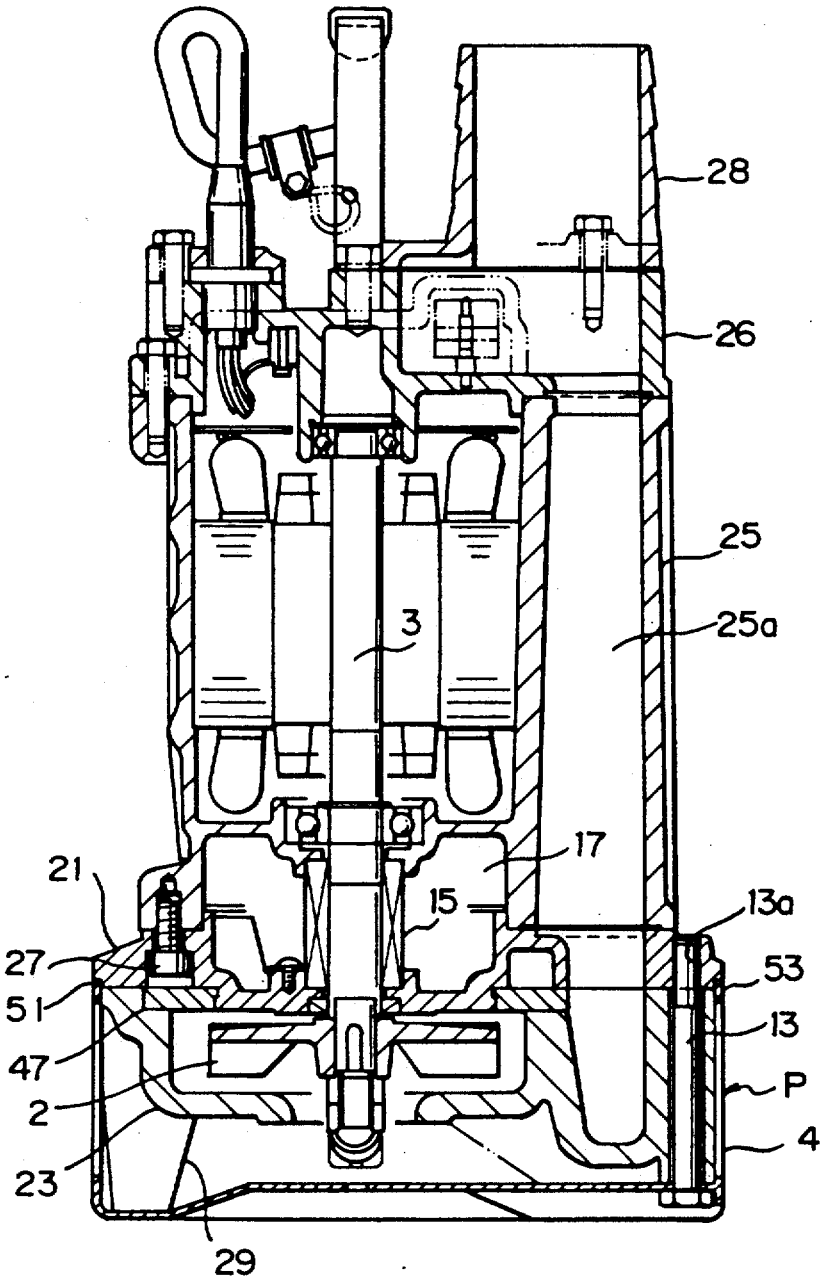
Figure 18A:
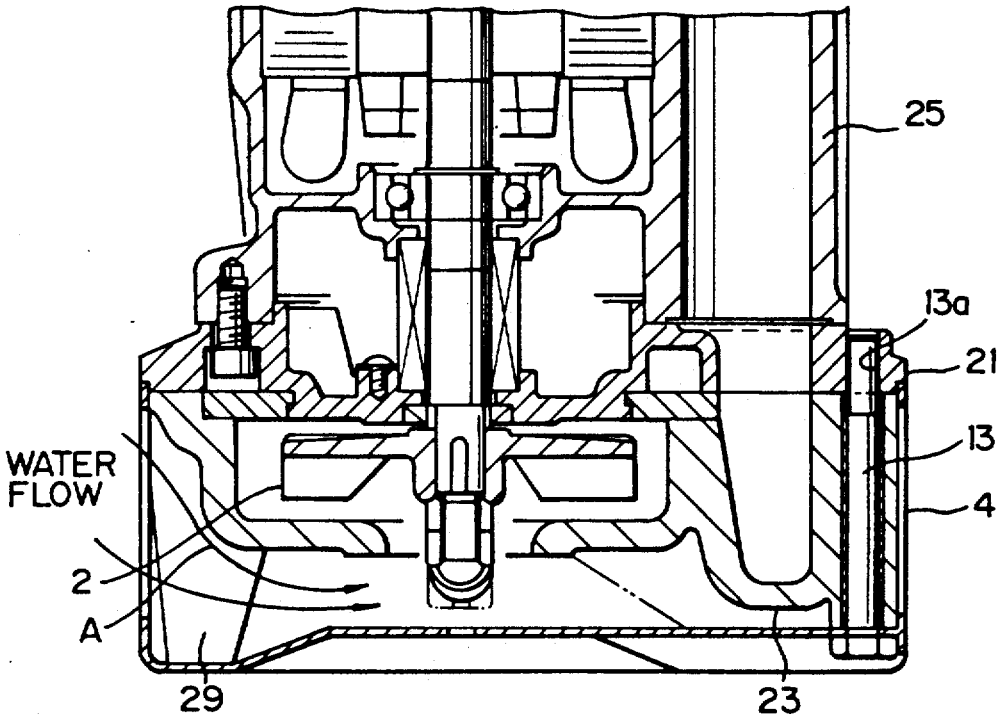
Figure 18B:
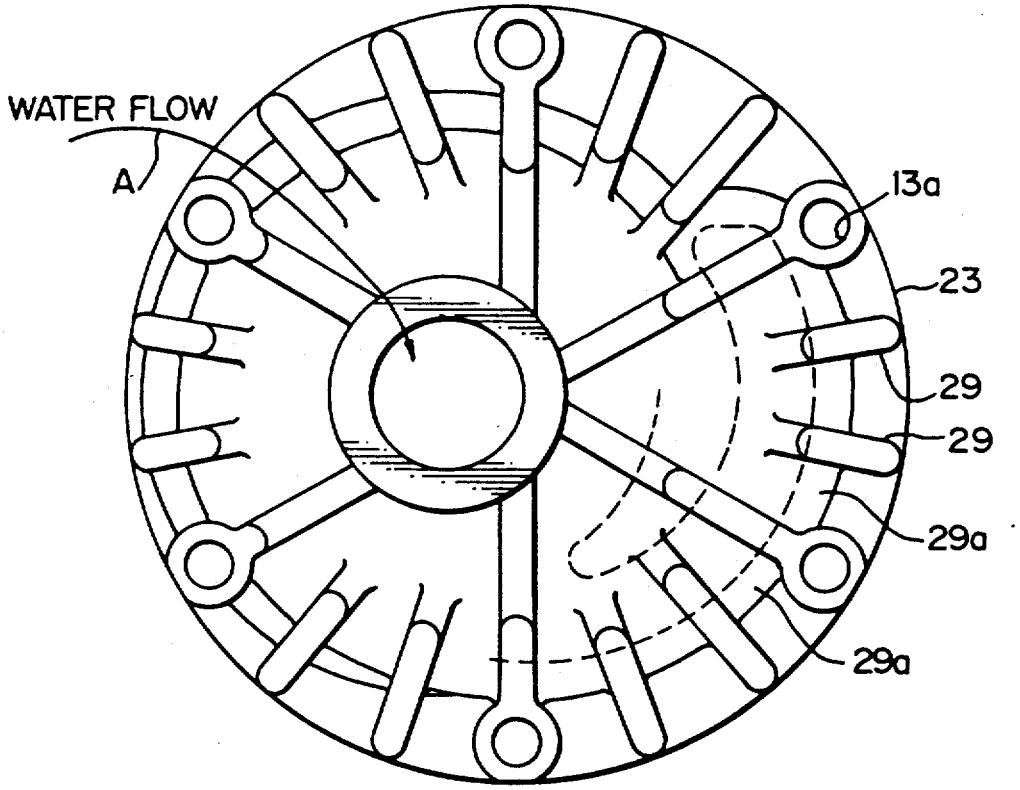
Figure 19:
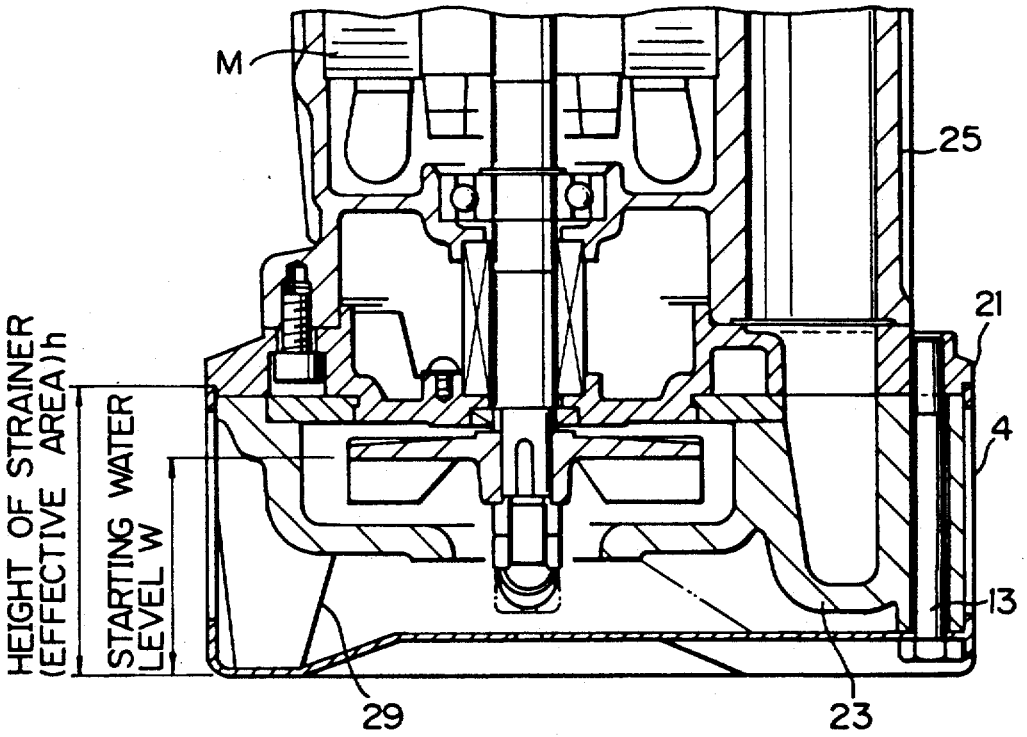
Figure 20:
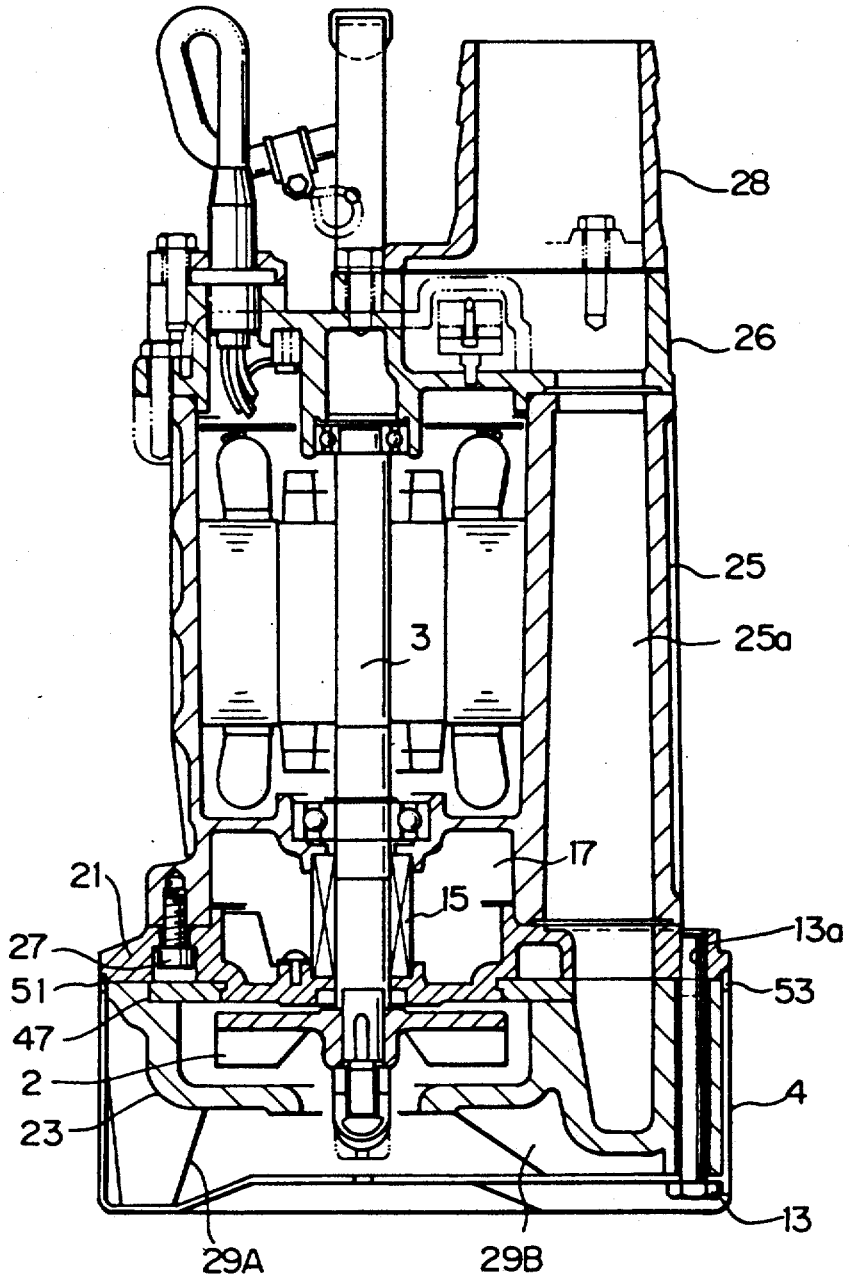

FIGS. 17 to 19 show a fourth embodiment of the present invention.

In this embodiment, an engagement portion 51 is provided at the lower end portion of the circumferential surface of the intermediate casing member 21, onto which the inner surface of the upper end 53 of the strainer 4 is engaged.

Similarly to the first embodiment, a plurality of legs 29, as shown in FIG. 18(*b*), are radially provided at the lower side (bottom surface) of the lower casing member 23, and a space between each leg 29 forms a channel 29*a* through which water passes.

As the motor pump according to this embodiment is configured as described above, upon operation, the upper end 53 of the strainer 4 is retained at the engagement portion 51 of the intermediate casing member 21 and deformation of the strainer 4 and the bolts 13 in an inwardly radial direction may be prevented even when an external force P is applied to the side of the strainer 4 in a horizontal direction. Further, since the radial legs 29 are held by the inner surface of the strainer 4, the deformation of the lower casing member 23 caused by an internal pump pressure may be prevented by the rigidity of the radial legs 29 and by the support from the strainer 4 even when the lower casing member 23 is made of a resilient body such as rubber without any reinforcement.

Further, since the upper end 53 of the strainer 4 is engaged on the upper part of the lower casing member 23, it provides a great height h to the strainer 4 in comparison with a conventional model (FIG. 1), which increases the effective area of the strainer and improves suction efficiency of the pump without increasing the outline dimensions of pump and the starting water level w, as shown in FIG. 19.

FIGS. 20 to 24 show a fifth embodiment of the present invention.

In this embodiment, the lower casing member 23 is made of an abrasion resistant resilient material such as rubber having no reinforcement and a number of rib-like legs 29 are provided on the lower surface of the lower casing member 23 as in the foregoing embodiments.

Figure 21A:
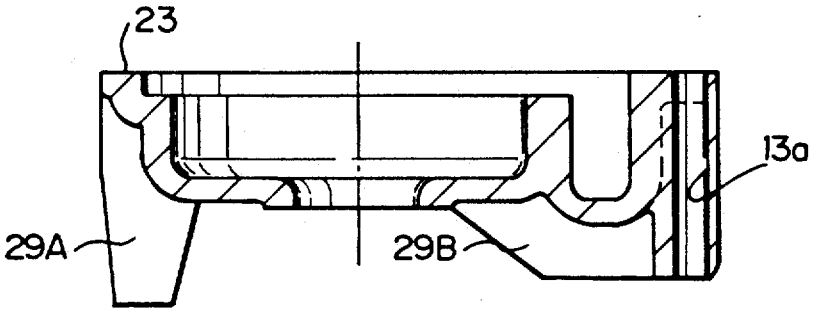
Figure 21B:
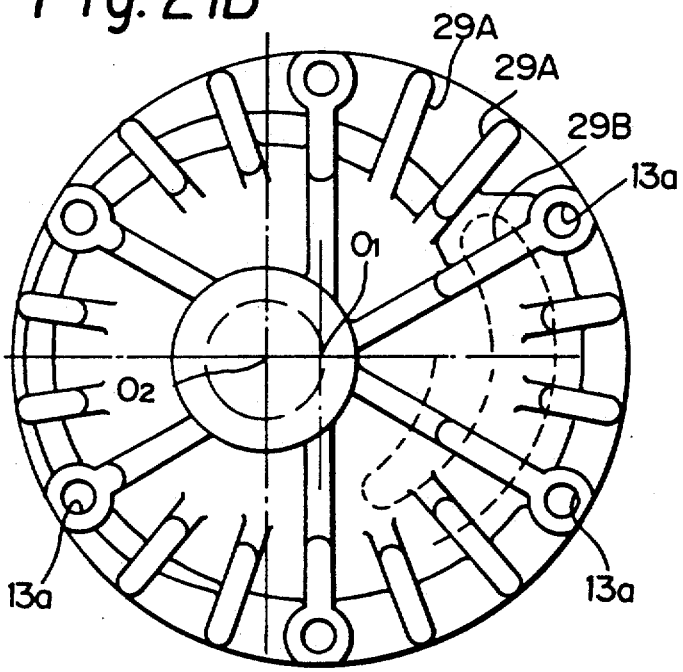

Several legs 29A of the legs 29 are, as shown in FIGS. 21(*a*), (*b*), shortened in length in the axial direction, and holes 13*a* for penetrating bolts 13 are provided on the short legs 29A, and a step portion 4*a* projecting toward the lower casing member 23 is, as shown in FIGS. 22(*a*), (*b*), formed on the bottom surface of the strainer 4, corresponding to and in contact with the lower end surface of the short legs 29A.

The step portion 4*a* of the strainer 4 projected toward the lower casing member 23 is provided with the bolt penetrating holes 4*b*, and connected with an opposite side step portion 4*a* through a straight rib passing through the center $O_1$ of the strainer. The step portion provided with the bolt penetrating hole 4*b* is, as shown in FIG. 22(*b*), opened to the outer circumferential side, so that a wrench 55 can be inserted thereinto without lifting the motor pump.

The step portion 4*a* adjacent to the bolt penetrating hole portion 4*b* and a bottom surface 4*e* of the strainer 4 are, as shown in FIGS. 23(*a*), (*b*), connected each other by an outwardly expanded slant surface 4*c* and an inwardly concaved spherical surface 4*d* having a semi-diameter of $R_1$ which is in contact with the slanted surface 4*c* and the bottom strainer surface 4*e*.

In FIG. 21, $O_2$ represents a central axis of impeller 2.

In the configuration as described above, upon operation, the strainer 4 can be prevented from deforming even if an external force such as an impact force is applied to the side of the strainer 13, since the upper end 53 of the strainer 4 is engaged on the lower end portion 51 of the intermediate casing member 21, since the side of the strainer 4 is supported on the bottom of the same through the rib-like legs 29A, 29B having different axial lengths, and since the bottom of the strainer includes several step portions 4*a* corresponding to the different lengths of the legs, which increases the area of the load bearing surface of the strainer 4.

Also, since a step portion 4*a* adjacent to the bolt penetrating hole portion 4*b* of a strainer 4 is projected toward the lower casing member and the head of bolt 13 does not directly come into contact with the ground in the state of the pump assembled for use, and since the step portion is opened to the outer circumferential side upon assembly or disassembly of a pump, a wrench 55 can be inserted and rotated, as shown in FIG. 22(*b*), from the opened outer circumferential side of the strainer 4, which facilitates assembly and disassembly work on the motor pump.

Since the step portion 4*a* adjacent the bolt penetrating hole portion 4*b* of the strainer is connected with an opposite step portion through a strainer rib passing through the center $O_1$ of the strainer 4, the strength of strainer 4 is reinforced and a flow of water taken into an inlet port of impeller via the strainer 4 is evenly and smoothly guided to the inlet port through the ribs.

Figure 24A:
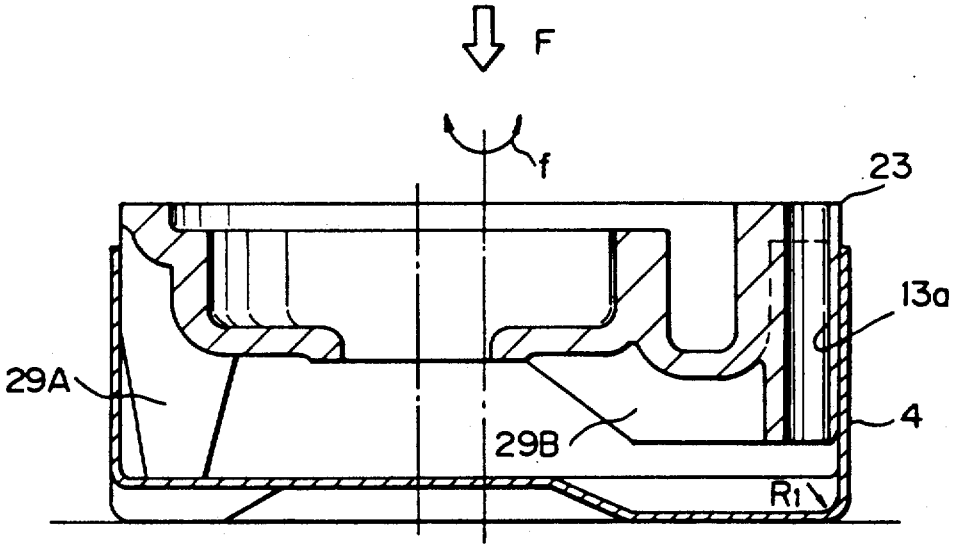
Figure 24B:
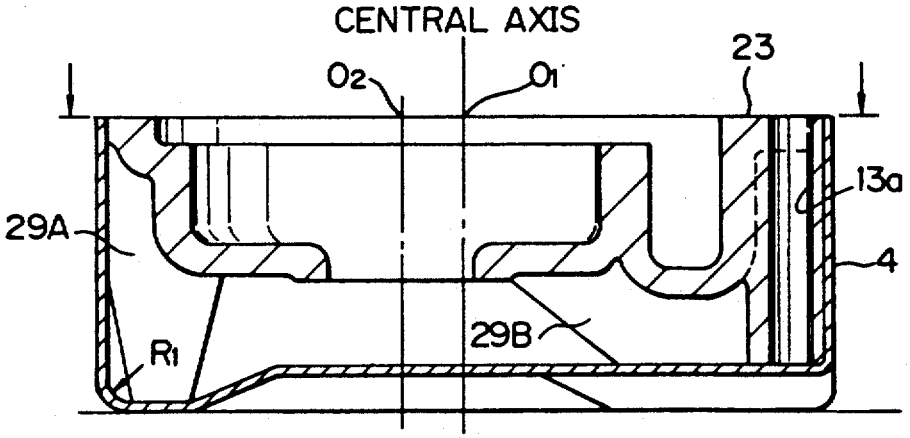

In addition, since a step portion 4*a* adjacent bolt penetrating hole portion 4*b* and bottom surface 4*e* of the strainer 4 are connected by a slant surface 4*c* and spherical surface 4*d* having a semidiameter of $R_1$, upon assembly, as shown in FIG. 24(*a*), when a downward force F is applied to the lower casing member 23, the lower casing member 23 rotates as indicated by an arrow f automatically in either direction due to the engagement of the lower ends of the rib-like legs 29A, 29B and the slant surface 4*c* and spherical surface 4*d* of the strainer and the positioning for the both elements, i.e. the lower casing member 23 and the strainer 4 is completed. Therefore, the efficiency of the assembling work is greatly improved.

In the last embodiment as described above, although the bolt penetrating hole 13*a* is provided on the short leg 29B of the lower casing member 23, however, a notch opened to the side may be used instead of the hole 13*a*.

Although in the foregoing embodiments the legs are radially provided on the lower side of the lower casing member, it should be noted that these legs do not necessarily need to be provided radially and that the legs are only required to have the outer end portions extended as far as the outer peripheral end of the lower casing member and to be spaced apart from each other to guide a fluid to the pump suction port.

In addition, the present invention is similarly applicable to an arrangement in which the lower casing member is made of a material other than an elastomeric material.

Further, the invention was explained referring to a specific type of motor pump, i.e. a single side water cooling motor pump. However, the invention is applicable to other types of motor pump, for example, an internal motor pump in which a motor pump body is surrounded with a pump outer casing to define a space therebetween and pumped water is discharged to the outside through the space to thereby cool the motor, as well as a so-called external motor pump in which a submerged motor pump is installed under water in a cistern, with a discharge port of the motor pump being opened into the cistern, and water which is to be pumped is led from the outside of the cistern to a suction port of the pump through a suction conduit and pumped water is discharged to the outside from a discharge port provided at the upper portion of the cistern.

What is claimed is:

1. A submergible motor pump including a vortex impeller attached to an end of a motor shaft, a pump casing attached to a motor casing and accommodating said impeller therein, a strainer attached to said pump casing for introducing water to be sucked into said pump casing, and a bottom plate supporting said strainer from therebelow, characterized in that: said pump casing comprises an intermediate casing member and a lower casing member, which are detachable from each other; said pump casing has a configuration in which the upper side is open so that the flow passage formed in said lower casing member does not have a bag-shaped configuration; a plurality of legs are provided on the lower side of said lower casing member as being integral portions thereof, the legs being spaced apart from each other and extending as far as the outer peripheral end of said lower casing member; said strainer is provided around the outer peripheral end of said lower casing member in such a manner as to surround the outer periphery of said lower casing member; and said lower casing member is clamped between said bottom plate and the intermediate casing member by means of clamping bolts, thereby assembling together said bottom plate, the lower casing member and the strainer in one unit.

2. A submergible motor pump according to claim 1, wherein the head of a bolt used to attach said intermediate casing member to said motor casing projects toward said lower casing member, which is provided with a recess so that said bolt head fits therein with a narrow gap therebetween.

3. A submergible motor pump according to claim 1 or 2, wherein said lower casing member is made of an elastomeric material.

4. A submergible motor pump according to claim 1, wherein said impeller is disposed within said pump casing so that a relatively wide gap is provided in front of said impeller.

5. A submergible motor pump according to claim 1, wherein said strainer and said bottom plate are constituted by separate elements and said strainer is clamped between said bottom plate and said intermediate casing member by means of said clamping bolts.

6. A submergible motor pump according to claim 1, wherein said strainer and said bottom plate are integrally formed by a single element.

7. A submergible motor pump according to claim 6, wherein said pump casing includes a channel extending from a volute portion to a discharge port formed by said intermediate casing member and said lower casing member, and a slope portion descending gradually toward the water flow direction is provided in said channel formed in said intermediate casing member.

8. A submergible motor pump according to claim 6, wherein said intermediate casing member is attached to said motor casing by means of bolts, the bolt head each thereof is received in a recess formed on the lower surface of said intermediate casing member, a replaceable ring which is made of an abrasion resistant resilient body is provided between the bottom surface of said intermediate casing member and the upper surface of said lower casing member so as to seal said bolts from a vortex water flow in said pump casing.

9. A submergible motor pump according to claim 8, wherein said resilient ring is formed from rubber.

10. A submergible motor pump according to claim 8, wherein an O ring-like projection is provided on the inner circumferential surface of said resilient ring, and an annular groove is provided on the side of said intermediate casing member for receiving said projection therein, said projection and said groove are fitted together to fit said resilient ring to said intermediate casing member.

11. A submergible motor pump according to claim 10, wherein an engagement groove for receiving the outer circumferential portion of said resilient ring is provided in the inner circumferential portion of said lower casing member so as to facilitate the positioning of said resilient ring onto said lower casing member.

12. A submergible motor pump according to claim 8, wherein an inner diameter $d_1$ and an outer diameter $d_2$ of said resilient ring is selected as $$0.8D_2 \leqq d_1 < d_2 \leqq 1.2 \times (D_2 + 2B_2)$$

where $D_2$: an outer diameter of the impeller $B_2$: a width of the blade of the impeller.

13. A submergible motor pump according to claim 8, wherein said resilient ring is arranged to cover a volute water cutting edge portion of said lower casing member.

14. A submergible motor pump according to claim 11, wherein a chamfer is provided on the lower surface of the circumferential portion of said resilient ring received in said engaging groove of said lower casing member.

15. A submergible motor pump according to any one of claims 8 to 14, wherein a projection is provided at the upper surface of said lower casing member corresponding to said recess which is not covered with said resilient ring.

16. A submergible motor pump according to claim 6, wherein an engagement portion is provided at the lower end portion of the circumferential surface of said intermediate casing member, and onto which the inner surface of the upper end of said strainer is engaged.

17. A submergible motor pump according to claim 16, wherein said lower casing member is made of a resilient body without any reinforcement, said legs are radially provided at the lower side of said lower casing member and a space is provided between each leg to form a channel through which water passes, and said radial legs are held by the inner surface of said strainer.

18. A submergible motor pump according to claim 6, wherein said legs are radially provided at the lower side of said lower casing member and a space is provided between each leg to form a channel through which water passes, several of said legs are shortened in length in the axial direction and holes or notches for penetrating bolts are provided in said short legs, and a step portion projecting toward said lower casing member is formed on the bottom surface of said strainer corresponding to and in contact with said lower end of said each short leg.

19. A submergible motor pump according to claim 18, wherein said step portion of said strainer is provided with hole or notch for penetration of the bolt and is connected with an opposite side step portion through a straight rib passing through the center of said strainer, said step portion is opened to the outer circumferential side so that a wrench for rotating said bolt can be inserted therethrough for assembling and or disassembling of the motor pump.

20. A submergible motor pump according to claim 18, wherein said step portion and the bottom surface of said strainer are connected to each other by an outwardly expanded slant surface and an inwardly concaved spherical surface which is in contact with said slant surface and the bottom surface of said strainer.

21. A submergible motor pump according to any one of claims 18 to 20, wherein said lower casing member is formed of a resilient body such as rubber having no reinforcement.

22. A submergible motor pump according to claims 1 or 6, wherein said motor pump is a single side water cooling motor pump.

23. A submergible motor pump according to claims 1 or 6, wherein said motor pump is an internal motor pump.

24. A submergible motor pump according to claim 1 or 6, wherein said motor pump is an external motor pump.

* * * * *